US010229646B2

(12) United States Patent
Wu

(10) Patent No.: US 10,229,646 B2
(45) Date of Patent: Mar. 12, 2019

(54) LIQUID CRYSTAL DISPLAY DRIVING SYSTEM AND METHOD

(71) Applicant: Shenzhen China Star Optoelectronics Technology Co., Ltd., Shenzhen, Guangdong (CN)

(72) Inventor: Yu Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 179 days.

(21) Appl. No.: 14/906,546

(22) PCT Filed: Aug. 29, 2015

(86) PCT No.: PCT/CN2015/088457
§ 371 (c)(1),
(2) Date: Jan. 20, 2016

(87) PCT Pub. No.: WO2017/024627
PCT Pub. Date: Feb. 16, 2017

(65) Prior Publication Data

US 2017/0193954 A1 Jul. 6, 2017

(30) Foreign Application Priority Data

Aug. 12, 2015 (CN) ..... 2015 1 0493236

(51) Int. Cl.
*G09G 3/36* (2006.01)

(52) U.S. Cl.
CPC ..... *G09G 3/3688* (2013.01); *G09G 3/3677* (2013.01); *G09G 2300/0426* (2013.01);
(Continued)

(58) Field of Classification Search
CPC ..... G09G 2310/0286; G09G 3/3677; G09G 3/3688
See application file for complete search history.

(56) References Cited

U.S. PATENT DOCUMENTS

2006/0071893 A1* 4/2006 Nishina ..... G09G 3/3688 345/89
2006/0202936 A1* 9/2006 Chen ..... G09G 3/3677 345/100

(Continued)

FOREIGN PATENT DOCUMENTS

CN 1841482 A 10/2006
CN 101276076 A 10/2008

(Continued)

*Primary Examiner* — Afroza Chowdhury
(74) *Attorney, Agent, or Firm* — Andrew C. Cheng

(57) ABSTRACT

The liquid crystal display (LCD) driving system contains a Printed Circuit Board (PCB), a Timing Controller, Source Drivers, an Inter-Integrated Circuit (I2C) bus, and Gate Drivers. The Timing Controller is configured on the PCB for transforming control signals from the LCD to data and scan control signals. The I2C bus connects the Timing Controller to the Source Drivers. The Timing Controller delivers data and scan control signals to the Source Drivers through the I2C bus following a protocol. The Gate Drivers are electrically connected to the Source Drivers for receiving scan control signals. The driving system is capable of employing fewer transmission wires to deliver the same control signals of the prior art from the Timing Controller by configuring I2C bus between the Timing Controller and the Source Drivers, thereby reducing wiring area on the PCB and wiring difficulty. A LCD driving method is also provided.

8 Claims, 3 Drawing Sheets

(52) U.S. Cl.
CPC ..... *G09G 2310/0278* (2013.01); *G09G 2310/0286* (2013.01); *G09G 2310/08* (2013.01)

(56) References Cited

U.S. PATENT DOCUMENTS

| | | | | |
|---|---|---|---|---|
| 2008/0094334 | A1* | 4/2008 | Baek | G09G 3/3677 345/89 |
| 2008/0143698 | A1* | 6/2008 | Lee | G09G 3/2096 345/204 |
| 2008/0273003 | A1* | 11/2008 | Jeon | G09G 3/3666 345/99 |
| 2009/0179922 | A1* | 7/2009 | Kurihara | G09G 3/3648 345/690 |
| 2012/0013589 | A1* | 1/2012 | He | G09G 3/3666 345/211 |
| 2013/0088477 | A1* | 4/2013 | Seong | G09G 1/005 345/211 |
| 2014/0055437 | A1* | 2/2014 | Ban | H03M 1/66 345/211 |
| 2015/0009113 | A1* | 1/2015 | Zeng | G09G 3/3677 345/100 |
| 2015/0279524 | A1* | 10/2015 | Feng | G09G 3/3688 345/690 |
| 2015/0287376 | A1* | 10/2015 | Lim | G09G 3/3677 345/92 |
| 2015/0310824 | A1* | 10/2015 | Yang | G09G 5/006 345/213 |
| 2016/0055811 | A1* | 2/2016 | Zhu | G09G 3/3648 345/214 |
| 2016/0335963 | A1* | 11/2016 | Wu | G09G 3/3607 |

FOREIGN PATENT DOCUMENTS

| | | | |
|---|---|---|---|
| CN | 101436398 | A | 5/2009 |
| CN | 103280205 | A | 9/2013 |
| CN | 103544915 | A | 1/2014 |
| CN | 103680435 | A | 3/2014 |
| CN | 104167190 | A | 11/2014 |
| CN | 104809999 | A | 7/2015 |
| EP | 1058233 | A2 | 12/2000 |
| KR | 20110003156 | U | 3/2011 |
| KR | 20110066735 | A | 6/2011 |
| KR | 20110072868 | A | 6/2011 |

* cited by examiner

LIQUID CRYSTAL DISPLAY DRIVING SYSTEM AND METHOD

CROSS REFERENCE

This application claims the priority of Chinese Patent Application No. 201510493236.8, entitled "Flat panel and flat panel display", filed on Aug. 12, 2015, the disclosure of which is incorporated herein by reference in its entirety.

FIELD OF THE INVENTION

The present disclosure relates to display technologies, and more particularly to a liquid crystal display driving system and a liquid crystal display driving method.

BACKGROUND OF THE INVENTION

Liquid crystal display (LCD) devices are playing more important roles in people's lives. LCD devices require complicated driving circuits to achieve their display function. In a Thin Film Transistor (TFT) LCD device, the driving circuit usually contains a Timing Controller (TCON) IC, Source Driver ICs, Gate Driver ICs, a grey-level circuit, a power circuit, etc. The Source Driver ICs turn display-related signals from the TCON IC into corresponding voltages to pixel electrodes for twisting the liquid crystal molecules. The Gate Driver ICs' have their output terminals connected to the TFTs' gates and sequentially output ON/OFF voltages to the TFTs. In practice, mini-Low Voltage Differential Signaling (mini-LVDS) is usually employed for transmitting digital data signals among the TCON IC, Source Driver ICs, and Gate Driver ICs. Therefore, a large amount of differential signals is delivered from the TCON IC to the Source Driver ICs and Gate Driver ICs. In the meantime, the TCON IC also has to deliver to the Source Driver ICs and Gate Driver ICs various other control signals such as polarity reversal (POL) signal, data lock (TP) signal, frame refresh (Start Vertical, STV) signal, clock (CKV) signal, Output Enable (OE) signal.

FIG. 1 is a schematic diagram showing a conventional LCD driving system. As illustrated, the LCD driving system contains a TCON IC 20', at least a Source Driver IC 30', and at least a Gate Driver IC 40'. The Source Driver ICs 30' are connected to the TCON IC 20' through wires 31' for transmitting control signals. The Gate Driver ICs 40' are connected to the TCON IC 20' through another set of wires 41' for transmitting control signals. Together with other wires (e.g. the data lines, not shown), there are a lot of wires among the TCON IC, Source Driver ICs, and Gate Driver ICs. In other words, there is a significant amount of wiring on the printed circuit board 10', and there is also a large number of leads from the ICs, both greatly increasing the difficulties of wiring and manufacturing and easily introducing electromagnetic interference.

SUMMARY OF THE INVENTION

The technical issue addressed by the present disclosure is to provide a liquid crystal display (LCD) driving system that not only can reduce the number of wires on the Printed Circuit Board (PCB) but also can reduce the wiring area.

The LCD driving system contains a PCB, a Timing Controller, a number of Source Drivers, an Inter-Integrated Circuit (I2C) bus, and a number of Gate Drivers. The Timing Controller is configured on the PCB for transforming control signals from the LCD to data and scan control signals. The I2C bus connects the Timing Controller to the Source Drivers. The Timing Controller delivers data and scan control signals to the Source Drivers through the I2C bus following a protocol. The Gate Drivers are electrically connected to the Source Drivers for receiving scan control signals.

Each Source Driver contains a Chip on Film (COF).

The LCD driving system further contains a LCD substrate and a number of transmission wires. The transmission wires connect the Source Drivers to the Gate Drivers. The transmission wires are configured on at least a COF and the LCD substrate for transmitting the scan control signals to the Gate Drivers.

The transmission wires form an I2C bus connecting at least a Source Driver to the Gate Drivers.

Each Source Driver has a hardware-configured fixed address or a software-configurable variable address for the I2C bus to identify.

Each Source Driver contains at least a shift register for storing the data control signals.

The present disclosure also provides a LCD driving method which contains the following steps:

turning control signals from the LCD into data and scan control signals by a Timing Controller;

searching a Source Driver by the Timing Controller using the Source Driver's address;

responding an acknowledgment signal by the Source Driver to the Timing Controller after the Source Driver is addressed;

delivering data and scan control signals to the Source Driver by the Timing Controller through an I2C bus after the Timing Controller receives the acknowledgment signal; and storing the received data control signals by the Source Driver in the Source Driver's shift registers so as to subsequently output data control signals under shift pulses, and delivering the received scan control signals to Gate Drivers.

The Source Driver's address is a hardware-configured fixed address or a software-configurable variable address for the I2C bus to identify.

A number of transmission wires connect the Source Drivers to the Gate Drivers for transmitting the scan control signals to the Gate Drivers.

The transmission wires form an I2C bus connecting at least a Source Driver to the Gate Drivers.

Compared to the prior art, the present disclosure has the following advantages. The present disclosure employs I2C bus between the Timing Controller and the Source Drivers and data and scan control signals are delivered to the Source Drivers and then from the Source Drivers to the Gate Drivers following a protocol, thereby reducing the number of transmission wires between the Timing Controller and the Gate Drivers. The fewer transmission wire imply reduced wiring area and fewer leads of the Integrated Circuits (ICs), and the dimension of the Timing Controller can be reduced too.

BRIEF DESCRIPTION OF THE DRAWINGS

In order to more clearly illustrate the embodiments of the present disclosure or prior art, the following figures will be described in the embodiments are briefly introduced. It is obvious that the drawings are merely some embodiments of the present disclosure, those of ordinary skill in this field can obtain other figures according to these figures without paying the premise.

DETAILED DESCRIPTION OF PREFERRED EMBODIMENTS

Embodiments of the present disclosure are described in detail with the technical matters, structural features, achieved objects, and effects with reference to the accompanying drawings as follows. It is clear that the described embodiments are part of embodiments of the present disclosure, but not all embodiments. Based on the embodiments of the present disclosure, all other embodiments to those of ordinary skill in the premise of no creative efforts obtained, should be considered within the scope of protection of the present disclosure.

In addition, the following embodiments are described along with the accompanied drawings. Directional terms such as "above," "below," "front," "back," "left," "right," "in," "out," "side," etc. are referred to the directions shown in the accompanied drawings. The directional terms are intended to better and more clearly describe and understand the present disclosure. They are not intended to specify or imply the referred device or element has to be of a certain direction, or operated or constructed along a certain direction. They therefore cannot be interpreted as limitations to the present disclosure.

In the following description, unless otherwise explicitly specified and limited, terms like "configure," "connect," etc. should be interpreted broadly. For example, components can be fixedly connected, detachably connected, mechanically connected, directly connected, connected through some intermediate component, or internally connected. For people skilled in the related art, they should be able to understand the meaning of these terms in the present disclosure.

In addition, unless otherwise specified, "multiple" means two or more, and "process" is not limited to an independent process. As long as the expected effect of the process can be achieved, the process can also be indistinguishable from other processes. Furthermore, "~" is used to specify a range of values where the two numbers before and after "~" are the minimum and maximum values included in the range. In the accompanied drawings, like or same components are marked with same references.

Figure 1:
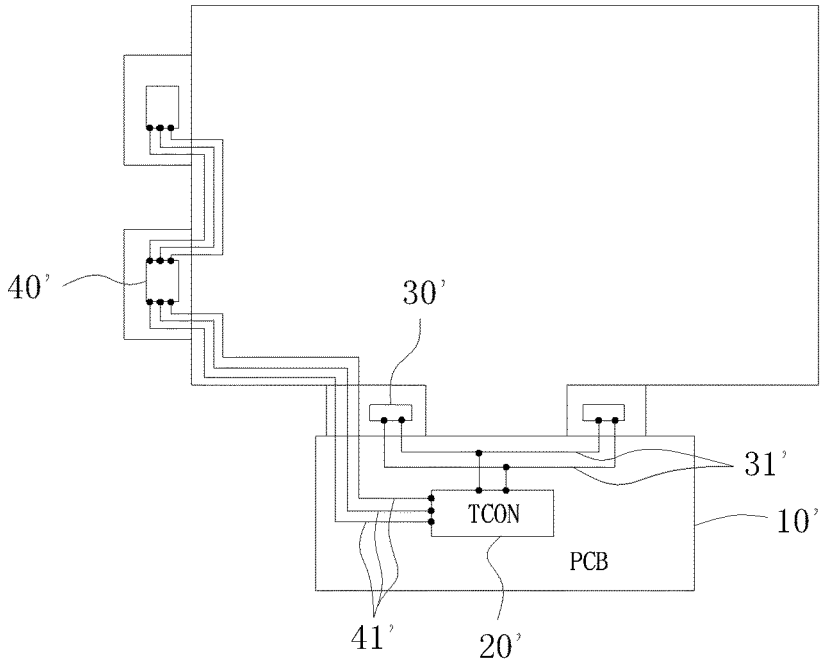
FIG. 1 (Prior Art)
FIG. 1 is a schematic diagram showing a conventional Liquid Crystal Display (LCD) driving system.
Figure 2:
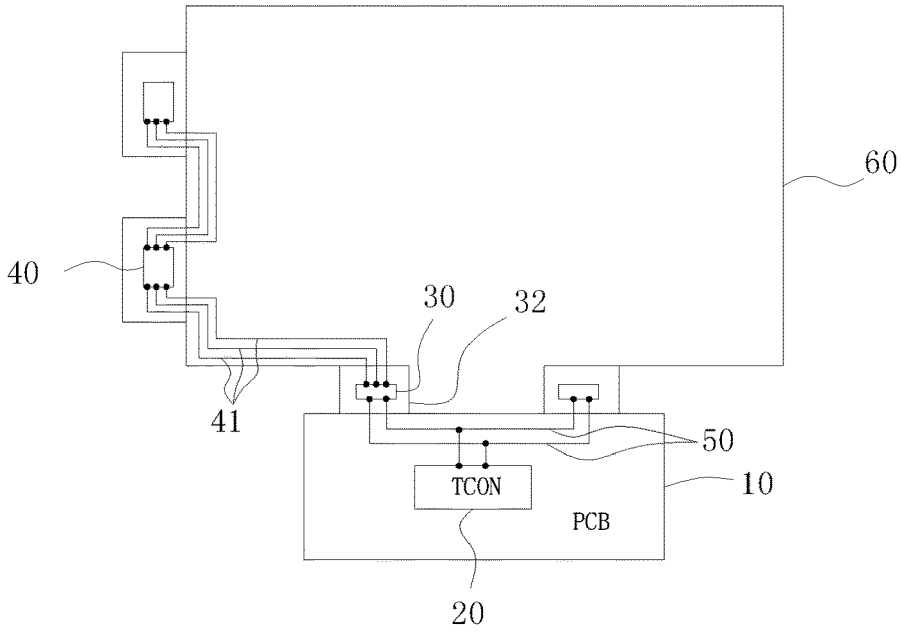
FIG. 2 is a schematic diagram showing a liquid crystal display (LCD) driving system according to a first embodiment of the present disclosure.

FIG. 2 is a schematic diagram showing a liquid crystal display (LCD) driving system according to a first embodiment of the present disclosure. As illustrated, the driving system contains a Printed Circuit Board (PCB) 10, a Timing Controller 20, multiple Source Drivers 30, multiple Gate Drivers 40, and an Inter-Integrated Circuit (I2C) bus 50.

The Timing Controller 20 transforms control signals from the LCD into data control signals and scan control signals. The data control signals are for Source Drivers 30 and the scan control signals are for the Gate Drivers 40. The control signals include Data Enable (DE) signal, Horizontal Sync (HS) signal, Vertical Sync (VS) signal. The data control signals include Polarity Reversal (POL) signal, Output Enable (OE) signal, etc. The scan control signals include Frame Refresh (STV) signal, pulse (TP) signal, clock (CKV) signal, etc. The Timing Controller is configured on the PCB 10 and is electrically connected to the PCB 10.

The I2C bus 50 contains bi-directional wires providing communication paths among Integrated Circuits (ICs). The I2C bus 50 contains two wires: Serial Data (SDA) wire and Serial Clock (SCL) wire. Specifically, the I2C bus 50 connects the Timing Controller 20 and the Source Drivers 30 where the data and scan control signals are altogether transmitted to a specific Source Driver 30 following the I2C protocol. Each Source Driver 30 has an address for the I2C bus to identify. The address can be a hardware-configured fixed address, or a software-configurable variable address.

Each Source Driver 30 also contain shift registers. Specifically, when a Source Driver 30 receives the data and scan control signals, they are stored in the shift registers so that they can subsequently output under the control of shifting pulses. The Gate Drivers 40 are electrically connected to and receive scan control signals from the Source Drivers 30 so as to control scan sequence. Usually, the number of wires for transmitting control signals on the PCB is larger than or equal to the number of the types of control signals. For example, if the control signals are of 7 types, at least 7 signal transmission wires are required. Since the present disclosure adopts I2C bus, the number of wires for transmitting control signals is reduced to 2, regardless the types and number of control signals. In addition, since the I2C bus 50 is only used to connect the Timing Controller 20 and Source Drivers 30 and no Gate Driver 40 is involved, transmission wires between the Timing Controller 20 and Gate Drivers 40 can be omitted, thereby reducing the complexity of wiring on the PCB 10.

As illustrated in FIG. 2, the driving system of the present embodiment also contains a LCD substrate 60. The LCD substrate 60 can be made of glass. Each Source Driver 30 can also contain Chip on Film (COF) 32 through which the Source Driver 30 is packaged. Specifically, multiple signal transmission wires 41 electrically connect between the Gate Drivers 40 and the Source Drivers 30, and between the Gate Drivers 40, so that scan control signals are delivered from the Source Drivers 30 to the Gate Drivers 40. The signal transmission wires 41 are configured on the COFs 32 of the Source Drivers 30 and on the LCD substrate 60. As shown in FIG. 2, the number of the signal transmission wires is 3. In alternative embodiments, the number of the signal transmission wires is determined by the number and types of scan control signals.

Figure 3:
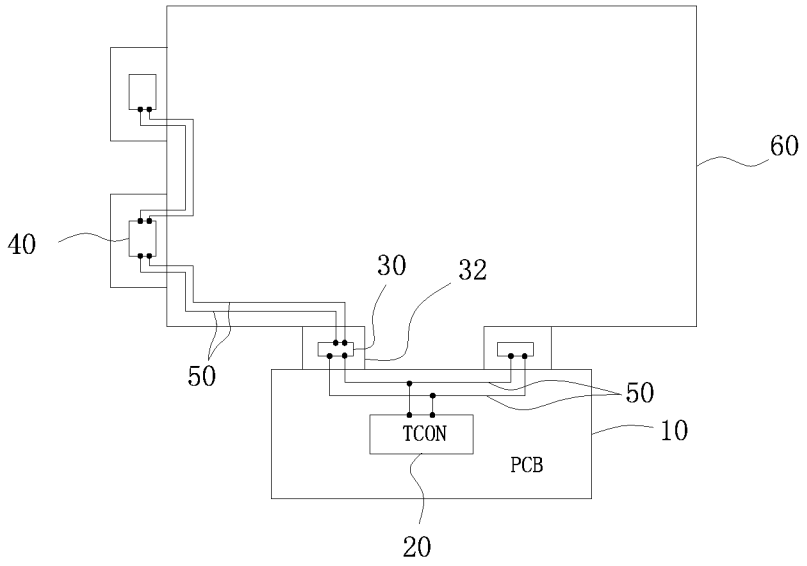
FIG. 3 is a schematic diagram showing a liquid crystal display (LCD) driving system according to a second embodiment of the present disclosure.

FIG. 3 is a schematic diagram showing a LCD driving system according to a second embodiment of the present disclosure. As illustrated, the driving system is basically identical to that of the previous embodiment. The difference lies in that, in the present embodiment, I2C bus 50 is employed to connect the Source Drivers 30 and the Gate Drivers 40 so as to deliver the scan control signals from the Source Drivers 30 to the Gate Drivers 40. The I2C bus 50 is configured on the COFs 32 of the Source Drivers 30 and on the LCD substrate 60. As such, there is a fewer number of wires on the LCD substrate 60, thereby reducing the LCD substrate 60's frame width.

Figure 4:
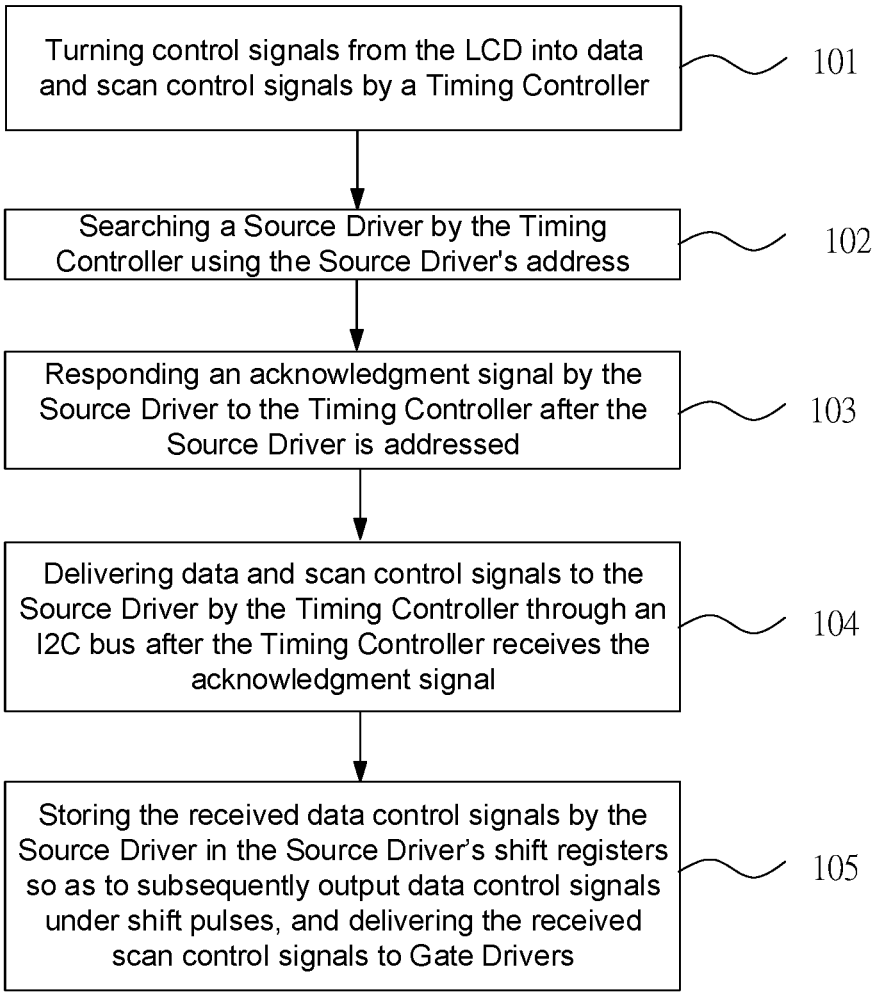
FIG. 4 is a flow diagram showing the steps of a LCD driving method according to an embodiment of the present disclosure.

FIG. 4 is a flow diagram showing the steps of a LCD driving method according to an embodiment of the present disclosure. As illustrated, the driving method contains the following steps.

Step 101: Turning control signals from the LCD into data control signals and scan control signals by a Timing Controller.

In the present embodiment, the control signals include Data Enable (DE) signal, Horizontal Sync (HS signal, Vertical Sync (VS) signal. The data control signals include Polarity Reversal (POL) signal, Output Enable (OE) signal, etc. The scan control signals include Frame Refresh (STV) signal, pulse (TP) signal, clock (CKV) signal, etc.

Step 102: Searching a Source Driver by the Timing Controller using the Source Driver's address.

In the present embodiment, each Source Driver has an address for I2C to identify. The address can be a hardware-configured fixed address, or a software-configurable variable address.

Step 103: Responding an acknowledgment signal from the Source Driver to the Timing Controller after the Source Driver is addressed.

Step 104: Delivering data and scan control signals to the Source Driver by the Timing Controller according to a protocol through I2C bus after the Timing Controller receives the acknowledgment signal.

In the present embodiment, the I2C bus contains bi-directional wires providing communication paths among ICs. The I2C bus contains two wires: SDA wire and SCL wire. Specifically, the I2C bus connects the Timing Controller and the Source Drivers where the data and scan control signals are altogether transmitted to a specific Source Driver following the I2C protocol.

Step 105: Storing the received data control signals by the Source Driver in the Source Driver's shift registers so as to subsequently output data control signals under shift pulses, and delivering the received scan control signal to Gate Drivers so as to control scanning.

In step 102, there can be only some Source Drivers that are configured with predetermined addresses and only these Source Drivers are addressed by the Timing Controller. In step 104, when the Timing Controller receives the acknowledgment signal from the addressed Source Driver, the Timing Controller delivers the data and scan control signals to the addressed Source Driver through I2C bus following I2C protocol. In step 105, after receiving the data and scan control signals from the Timing Controller, the addressed Source Driver delivers the data control signals to the other Source Drivers. In the meantime, the scan control signal is delivered to a specific Gate Driver which in turn delivers the scan control signal to the other Gate Drivers.

As described above, the present disclosure is capable of employing fewer transmission wires to deliver the same control signals of the prior art from the Timing Controller by configuring I2C bus between the Timing Controller and the Source Drivers, thereby reducing wiring area on the PCB and wiring difficulty.

In an alternative embodiment, in step 104, the Source Driver is capable of delivering scan control signal to a specific Gate Driver through I2C bus.

In an alternative embodiment, in step 102, the addresses of the Source Drivers can be configured through software and as such are adjustable.

In an alternative embodiment, in step 102, the addresses of the Source Drivers can be configured through hardware and as such are fixed.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A liquid crystal display (LCD) driving system, comprising a Printed Circuit Board (PCB), a Timing Controller, a plurality of Source Drivers, an Inter-Integrated Circuit (I2C) bus, and a plurality of Gate Drivers;

wherein the Timing Controller is configured on the PCB for transforming control signals from the LCD to data and scan control signals; the I2C bus connects the Timing Controller to the Source Drivers; each Source Driver has a hardware-configured fixed address or a software-configurable variable address for the I2C bus to identify; the Timing Controller delivers data and scan control signals to the Source Drivers by their addresses through the I2C bus following a protocol; the Gate Drivers are series-connected to a Source Driver by the I2C bus; and the Source Driver transmit scan control signals to the Gate Drivers through the I2C bus.

2. The LCD driving system according to claim 1, wherein each Source Driver comprises a Chip on Film (COF).

3. The LCD driving system according to claim 1, wherein each Source Driver comprises at least a shift register for storing the data control signals.

4. The LCD driving system according to claim 2, wherein each Source Driver comprises at least a shift register for storing the data control signals.

5. The LCD driving system according to claim 2, wherein each Source Driver comprises at least a shift register for storing the data control signals.

6. The LCD driving system according to claim 2, wherein each Source Driver comprises at least a shift register for storing the data control signals.

7. A LCD driving method, comprising the steps of:

turning control signals from the LCD into data and scan control signals by a Timing Controller;

searching a Source Driver by the Timing Controller using the Source Driver's address;

responding an acknowledgment signal by the Source Driver to the Timing Controller after the Source Driver is addressed;

delivering data and scan control signals to the Source Driver by the Timing Controller through an I2C bus after the Timing Controller receives the acknowledgment signal; and storing the received data control signals by the Source Driver in the Source Driver's shift registers so as to subsequently output data control signals under shift pulses; and delivering the received scan control signals by the Source Driver to a plurality of Gate Drivers through the I2C bus series-connecting the Gate Drivers and series-connecting the Gate Drivers to the Source Driver.

8. The LCD driving method according to claim 7, wherein the Source Driver's address is a hardware-configured fixed address or a software-configurable variable address for the I2C bus to identify.

* * * * *